US008390414B2

(12) United States Patent
Wei et al.

(10) Patent No.: US 8,390,414 B2
(45) Date of Patent: Mar. 5, 2013

(54) MULTI-PHASE TRANSFORMER

(75) Inventors: Lixiang Wei, Whitefish Bay, WI (US); Bruce W. Weiss, Whitefish Bay, WI (US); Nickolay N. Guskov, Mequon, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 124 days.

(21) Appl. No.: 12/901,311

(22) Filed: Oct. 8, 2010

(65) Prior Publication Data

US 2012/0086533 A1 Apr. 12, 2012

(51) Int. Cl.
*H01F 27/08* (2006.01)
*H01F 30/12* (2006.01)
*H01F 27/10* (2006.01)

(52) U.S. Cl. ..... 336/55; 336/5; 336/58

(58) Field of Classification Search ..... 336/5, 55, 336/59, 60, 57, 61, 196, 214; 363/148, 157
See application file for complete search history.

(56) References Cited

U.S. PATENT DOCUMENTS 2,990,443 A * 6/1961 Camilli ..... 174/15.1
2,990,528 A * 6/1961 Zimsky et al. ..... 336/58
3,264,589 A * 8/1966 Dutton ..... 336/57
3,431,524 A * 3/1969 Broverman ..... 336/60
3,548,354 A * 12/1970 Schwab ..... 336/57
3,902,146 A * 8/1975 Muralidharan ..... 336/57
4,000,482 A * 12/1976 Staub et al. ..... 336/60
4,173,747 A * 11/1979 Grimes et al. ..... 336/60
5,138,294 A * 8/1992 Yoshikawa ..... 336/60
5,296,829 A * 3/1994 Kothmann et al. ..... 336/60
6,844,802 B2 * 1/2005 Drummond et al. ..... 336/61
6,982,884 B1 * 1/2006 Paice ..... 363/44
7,161,454 B2 * 1/2007 LaBoube et al. ..... 336/55
7,330,095 B2 * 2/2008 Talja et al. ..... 336/5
2006/0001516 A1 * 1/2006 Mazur et al. ..... 336/5
2010/0176755 A1 * 7/2010 Hoadley et al. ..... 318/105

* cited by examiner

*Primary Examiner* — Mohamad Musleh
*Assistant Examiner* — Joselito Baisa
(74) *Attorney, Agent, or Firm* — Fletcher Yoder P.C.; Alexander R. Kuszewski; John M. Miller

(57) ABSTRACT

A transformer for converting 3 phase AC to 9 phase AC power is provided. The transformer comprising a laminated core, first, second and third coils constructed on the laminated core, each coil including several windings. Cooling ducts are provided in each coil, wherein at least one cooling duct is disposed between the laminated core and an adjacent winding of the respective coil. The transformer further includes first, second and third input terminals each linked to the first, second and third coils, and configured to receive a first, second and third phases of input AC power and first through ninth output terminals linkable to first through ninth output power lines.

20 Claims, 8 Drawing Sheets

MULTI-PHASE TRANSFORMER

BACKGROUND

The present invention relates generally to transformers such as those used in power conversion systems. More particularly, the present invention relates to multi-phase transformers winding placement with different number of air ducts.

Multi-phase transformers such as 9 phase transformers, are configured to convert a 3-phase AC input power to a multi-phase (e.g. 9 phase) AC output power. Such transformers are typically designed to provide a desired output AC power. The output AC power generated by the transformer may be rectified or filtered before being supplied to a load.

Typically, a 9 phase transformer includes 3 coils constructed on a laminated core. Each coil is formed of several windings. For example, in many 9 phase transformers, each coil is formed of five separate windings. Thus, the 9 phase transformer is typically formed using 15 windings connected in series.

During operation, leakage inductance is present in each winding of the coil. The leakage inductance in each coil often is typically unequal due to placement of the windings and air ducts. Such unbalanced leakage inductance causes an increase in the total harmonic distortion in the input power.

One technique often employed to reduce leakage inductance is winding the coil in different layers, each layer including several windings. For example, for a coil including five separate windings, one layer may be formed using first two windings and a portion of the third winding and a second layer may be formed with the other portion of the third winding and the remaining two windings. However, constructing the coil in multiple layers causes excessive heat generation that can eventually damage the transformer if the winding size is not properly selected.

To reduce the cost or reduce the winding temperature, Cooling ducts are typically employed to dissipate the heat generated by the transformer. However, there is a constraint on the number of cooling ducts that can be accommodated in the transformer as an increased number of cooling ducts will increase the size and the cost of the system as well. Therefore, there is a need to design a multi-phase transformer with an effective cooling system.

BRIEF DESCRIPTION

Briefly, according to one embodiment of the invention, a transformer for converting 3 phase AC power to 9 phase AC power is provided. The transformer comprises a laminated core, first, second and third coils constructed on the laminated core, each coil including several windings. Cooling ducts are provided in each coil, wherein at least one cooling duct is disposed between the laminated core and an adjacent winding of the respective coil. The transformer further includes first, second and third input terminals each linked to the first, second and third coils, and configured to receive a first, second and third phases of input AC power, and first through ninth output terminals linkable to first through ninth output power lines.

In another embodiment, a transformer for converting 3 phase AC power to 9 phase AC power is provided. The transformer includes a laminated core and a first, second and third coils constructed on the laminated core. Each coil forms five separate windings including first, second, third, fourth and fifth windings. The transformer further includes a plurality of cooling ducts in each coil, wherein at least one cooling duct is disposed between the laminated core and an adjacent winding of the respective coil. The transformer further includes first, second and third input terminals each linked to the first, second and third coils, and configured to receive a first, second and third phases of input AC power and first through ninth output terminals linkable to first through ninth output power lines. The first, second and third input terminals and the first through ninth output terminals are disposed on an outer surface of the transformer.

In another embodiment, a method for making a transformer for converting 3 phase AC power to 9 phase AC power is provided. The method comprises constructing first, second and third coils around a laminated core, each coil having a plurality of windings coupled together to form a transformer. The method further includes providing a plurality of cooling ducts for each coil with at least one cooling duct disposed between the laminated core and an adjacent winding of the respective coil. The method further includes providing 3 input terminals and 9 output terminals on an outer surface of the transformer.

DRAWINGS

These and other features, aspects, and advantages of the present invention will become better understood when the following detailed description is read with reference to the accompanying drawings in which like characters represent like parts throughout the drawings, wherein.

Figure 4:
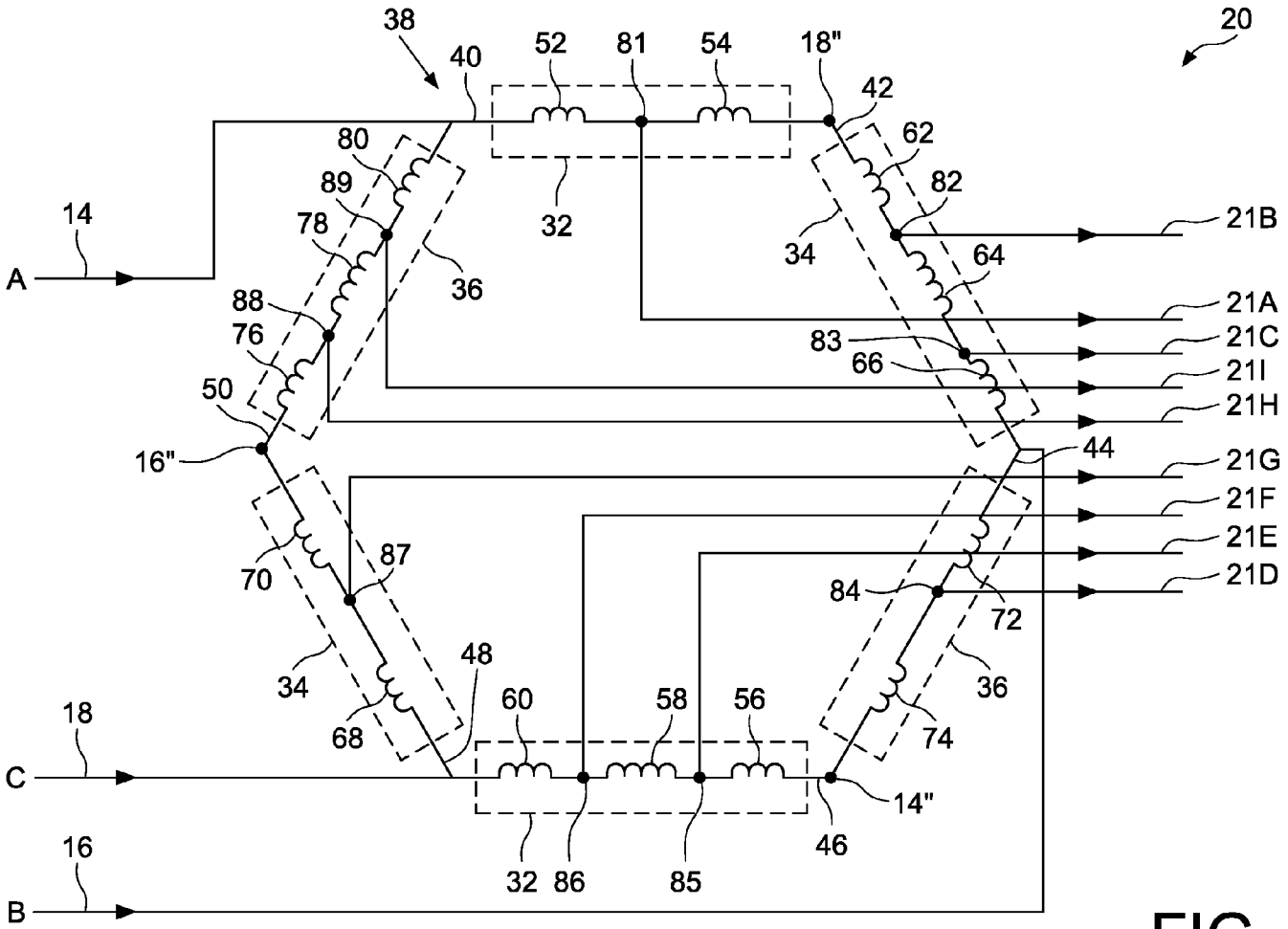
Figure 7:
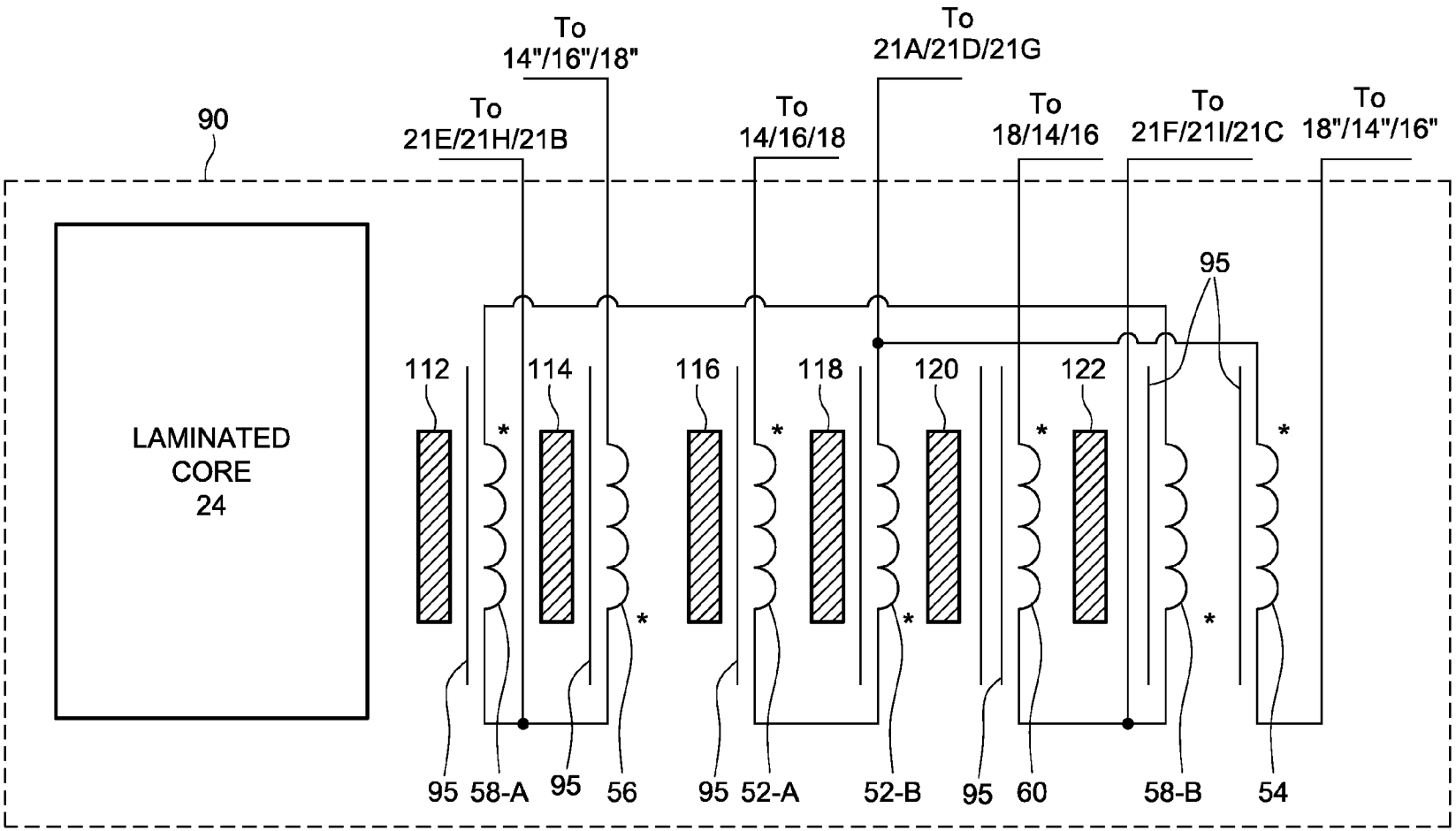
Figure 8:
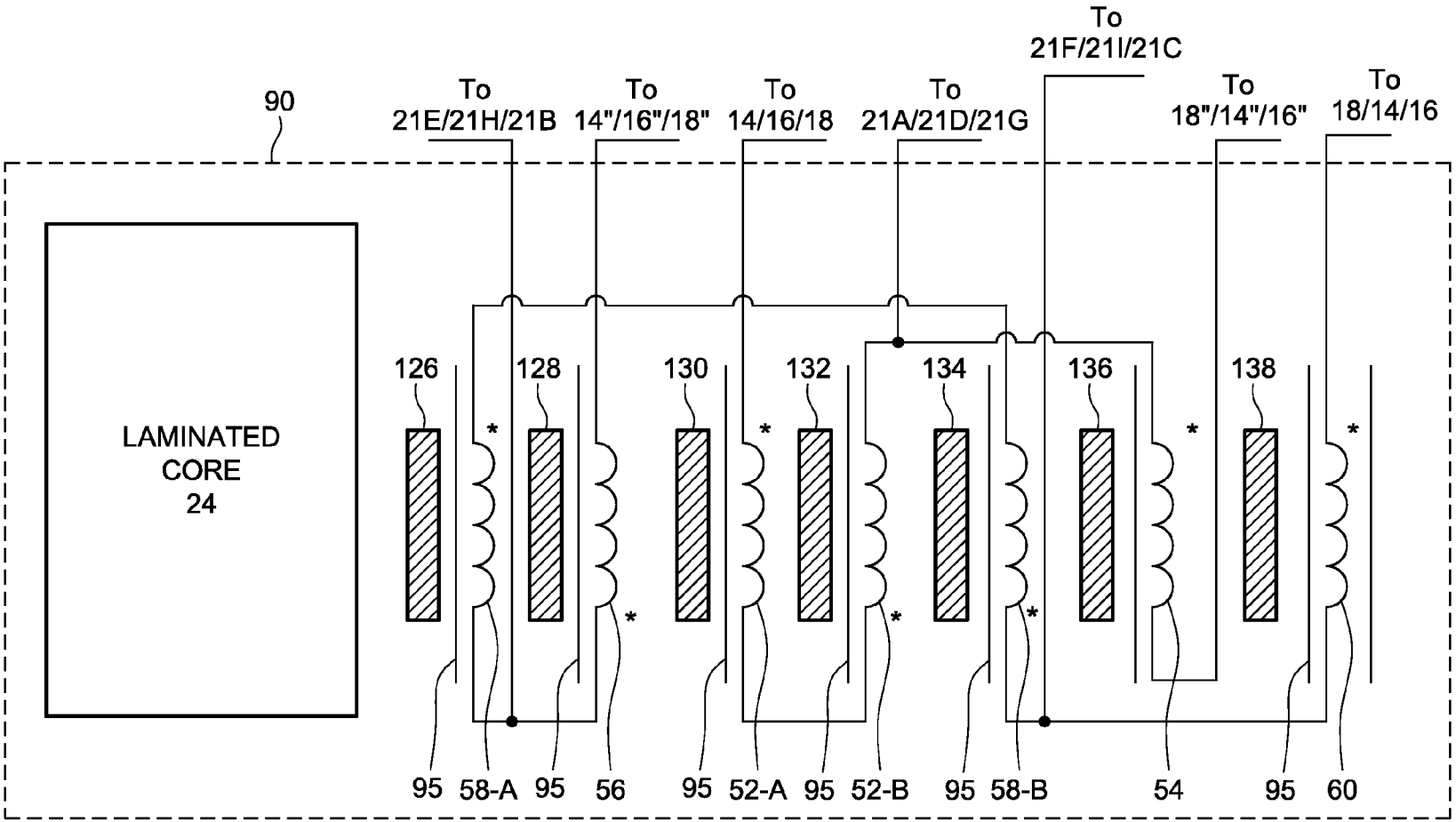
Figure 9:
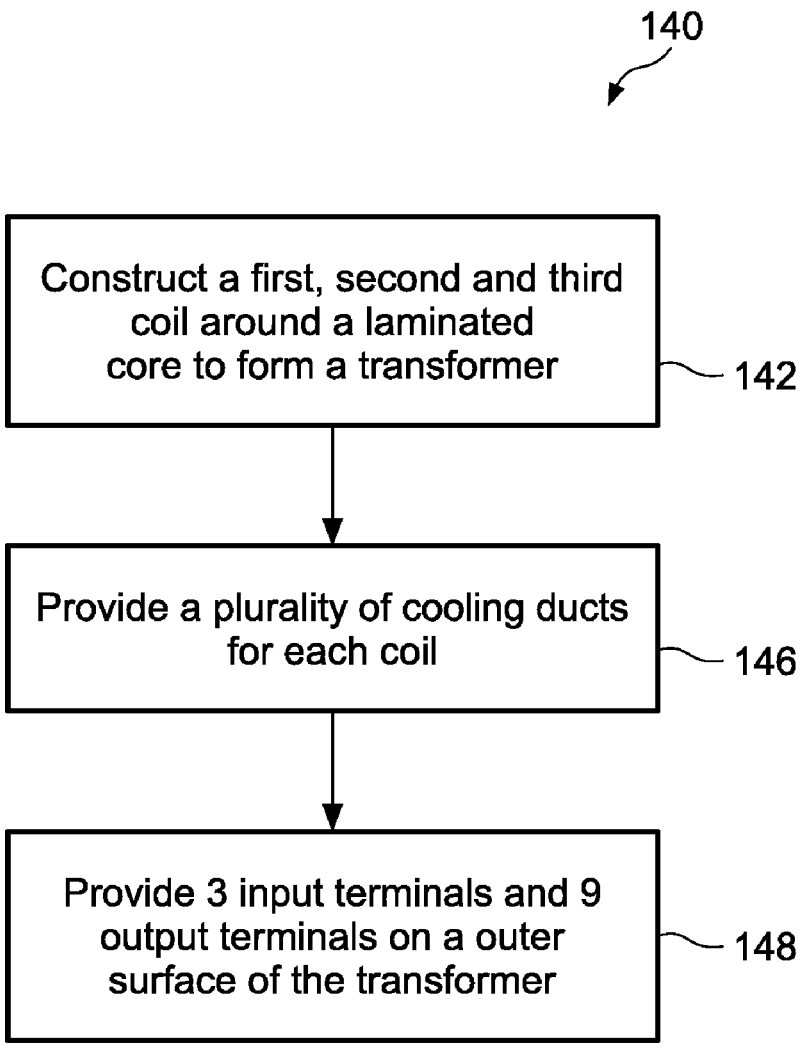

FIG. 4 is an electrical circuit diagram of the exemplary transformer implemented according to aspects of the present techniques; the proposed method are only applicable to the transformer from this figure FIG. 5, FIG. 6, FIG. 7 and FIG. 8 are cross sectional views of exemplary embodiments of a transformer implemented according to aspects of the present technique; and FIG. 9 is a flow chart illustrating an exemplary technique for making a transformer according to aspects of the present invention.

DETAILED DESCRIPTION

Figure 1:
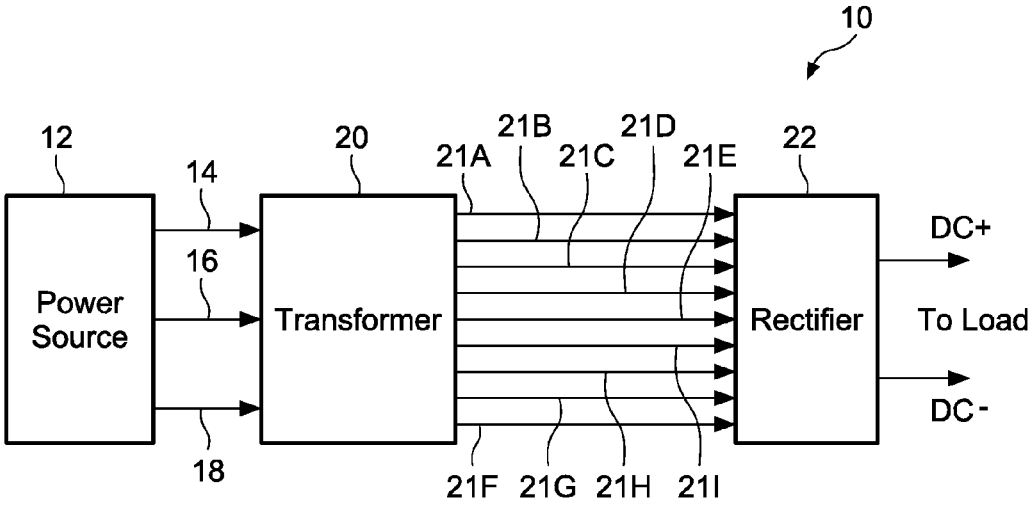
FIG. 1 is a block diagram of an exemplary embodiment of a power system implemented according to aspects of the present technique.

Turning now to the drawings, and referring first to FIG. 1, a power system 10 is illustrated. The power system 10 comprises a power source 12, a transformer 20 and a rectifier 22. The output power generated by the power system 10 is provided to a load. Examples of loads include motors, drives, and so forth. Each block is described in further detail below.

It should be noted that references in this specification to "one embodiment", "an embodiment", "an exemplary embodiment", indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The power source 12 is configured to generate or provide 3 phase AC power, and in many cases may comprise the utility grid. The 3 phase AC power may be provided to various electrical devices such as to the transformer 20. Moreover, the transformer 20 is coupled to the power source 12 and receives 3 phase AC power. The 3 phase AC power is provided to 3 separate input terminals 14, 16 and 18 as first, second and third phases. In this exemplary embodiment, the transformer 20 is configured to convert 3 phase AC power to 9 phase AC output power. In the illustrated embodiment, the output power is provided to the rectifier 22 via 9 output lines 21-A through 21-I, respectively.

Moreover, the rectifier 22 is configured to convert the 9 phase output AC power to corresponding DC voltage across a DC bus (not shown). In one embodiment, the rectifier 22 includes a switch-based bridge including two switches (not shown) for each AC voltage phase which are each linked to the DC bus. The switches are alternately opened and closed in a timed fashion that causes rectification of the 9 phase AC output power generated by the transformer 20.

The rectified output DC power may be provided to the load or may be used for various downstream circuits (e.g., inverters, choppers, converters). Other types and topologies of rectifiers, and indeed other uses for the 9 phase output may be employed. As described above, the transformer 20 is configured to convert 3 phase AC power to 9 phase AC power. The components used to construct the transformer 20 are described in further detail below with reference to FIG. 2.

Figure 2:
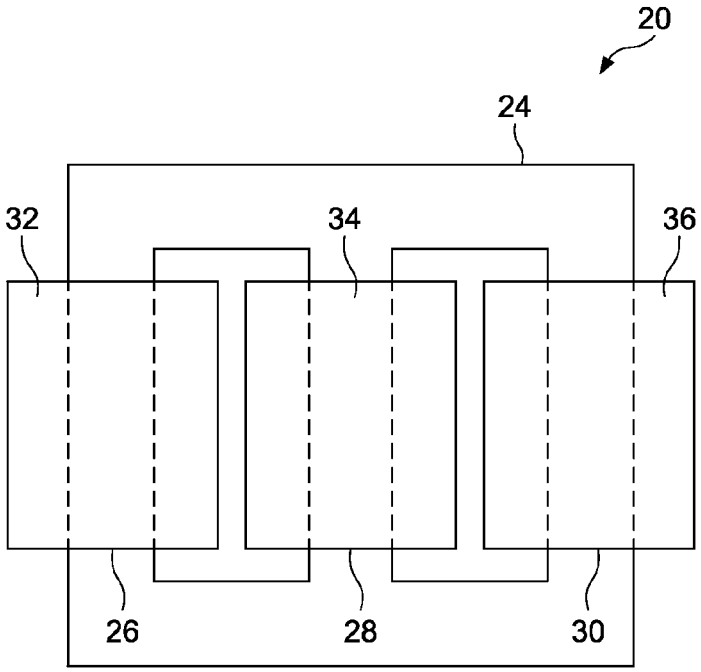
FIG. 2 is a front view of a core and coils of an exemplary transformer according to the present invention.
Figure 3:
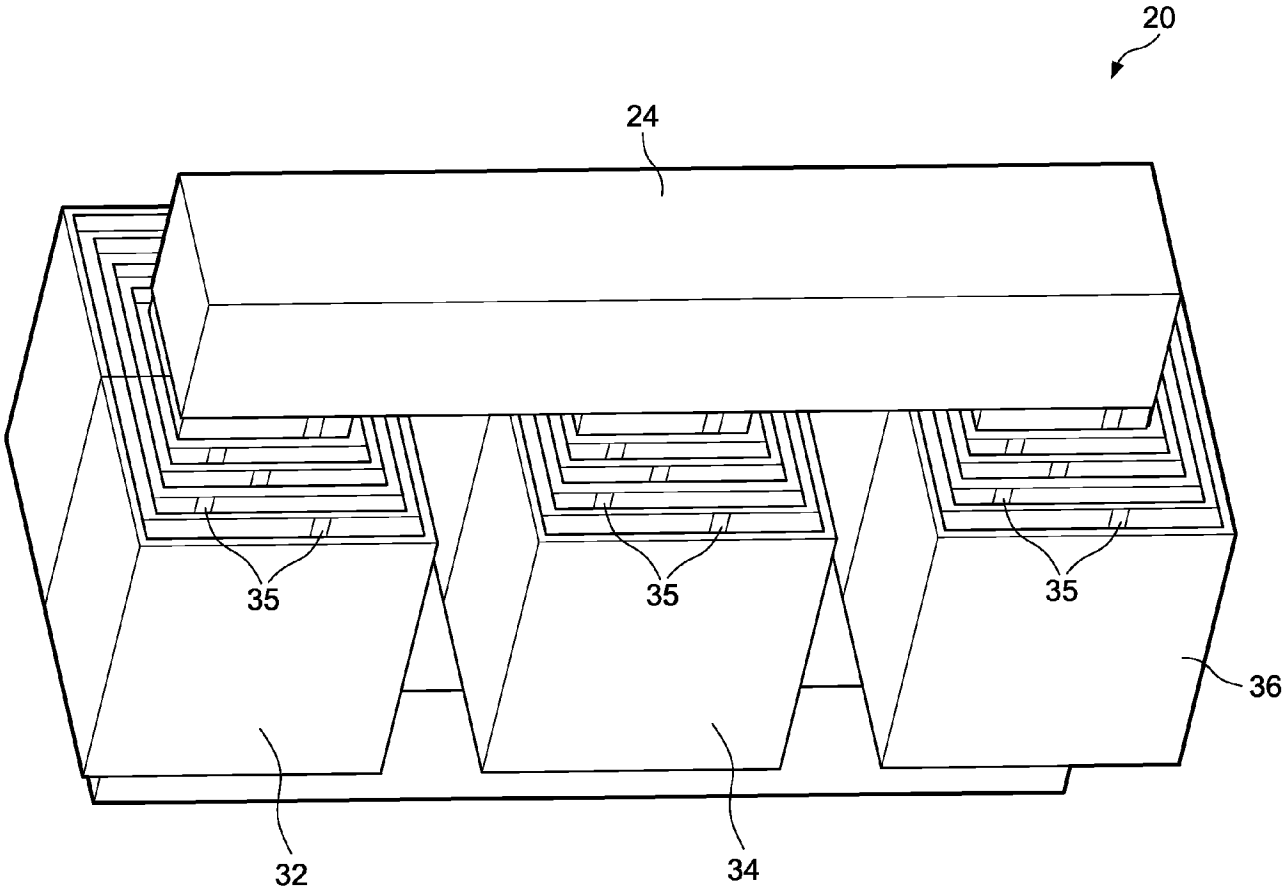
FIG. 3 is a perspective view of a core and coils of an exemplary transformer according to the present invention.

FIG. 2 is a block diagram illustrating one embodiment of a transformer 20 implemented according to aspects of the present techniques. FIG. 3 is a perspective view of a core and coils of a transformer of FIG. 2. The transformer 20 is constructed on a laminated core 24. In one embodiment, the laminated core 24 is made of electrical grade steel. The laminated core 24 includes 3 poles 26, 28 and 30 that form a path for magnetic flux. In a presently contemplated embodiment, core 24 has no other magnetic flux paths than the 3 traversing poles such that the flux flowing through one pole (e.g., pole 34) returns upwards through the other two poles (e.g., pole 32 and 36).

The poles 26, 28 and 30 pass through first, second and third coils 32, 34 and 36 respectively. In one embodiment, each coil (e.g., 32, 34 and 36) includes several windings coupled together in series. Further, each coil includes several cooling ducts represented generally by reference numeral 35, disposed between the windings. In one embodiment, each coil has first, second, third, fourth and fifth windings. Each winding may be constructed using a single winding specific wire.

Alternatively, several series windings may be constructed using a single wire or all of the windings may be constructed using a single wire. In one embodiment, all of the windings have a similar construction, the distinction being primarily in the number of turns that are included in each winding. The manner in which the windings are linked to form the transformer 20 is described in further detail below.

FIG. 4 is an electrical circuit diagram of the transformer 20 implemented according to aspects of the present techniques. In this exemplary embodiment, the transformer 20 includes 3 coils 32, 34 and 36 coupled to each other to form a hexagon 38. Further each coil 32, 34 and 36 has a plurality of windings. In the illustrated embodiment, each coil includes five separate windings and is positioned as described below.

As can be seen in FIG. 4, the first coil 32 includes windings 52 and 54 formed on a leg 40 of the hexagon 38. The first coil 32 further includes windings 56, 58 and 60 formed on a fourth leg 46 of the hexagon 38. Similarly, the second coil 34 includes windings 62, 64 and 66 formed on a second leg 42 of the hexagon 38. The second coil 34 further includes windings 68 and 70 on a fifth leg 48 of the hexagon 38. Lastly the third coil 36 includes windings 72 and 74 on a third leg 44 of the hexagon 38, and further includes windings 76, 78 and 80 on a sixth leg 50 of the hexagon 38.

The input terminals 14, 16 and 18 are configured to receive a first, second and third phases or power, represented generally by the letters A, B and C. The 3 input terminals are each coupled to first, second and third coils respectively. More specifically, the input terminal 14 is provided between winding 80 and winding 52. Similarly, input terminal 16 is provided between winding 66 and winding 72, and input terminal 18 is provided between winding 60 and winding 68. In alternate embodiments, the input terminals may be provided at positions 14", 16" and 18" as shown in FIG. 4

The transformer 20 further includes 9 output terminals 21-A through 21-I as shown. The first output terminal 21-A is positioned at a node 81 between the first winding 52 and second winding 54 of the first coil 32. The second output terminal 21-B is positioned at a node 82 between first winding 62 and second winding 64 of the second coil 34. The third output terminal 21-C is positioned at a node 83 between the second winding 64 and third winding 66 of the second coil 34.

The fourth output terminal 21-D is positioned at a node 84 between the first winding 72 and second winding 74 of the third coil 36. The fifth output terminal 21-E is positioned at a node 85 between the third winding 56 and fourth winding 58 of the first coil 32. The sixth output terminal 21-F is positioned at a node 86 between the fourth winding 58 and fifth winding 60 of the first coil 32.

The seventh output terminal 21-G is positioned at a node 87 between the fourth winding 68 and fifth winding 70 of the second coil 34. The eighth output terminal 21-H is positioned at a node 88 between the third winding 76 and fourth winding 78 of the third coil 36. The ninth output terminal 21-I is positioned at a node 89 between the fourth winding 78 and fifth winding 80 of the third coil 36.

The transformer 20 includes several cooling ducts disposed between the windings of each coil. In one embodiment, each coil of the transformer 20 includes at least five cooling ducts on each side of the coil. The cooling ducts disposed between the windings of the coil. The manner in which the cooling ducts are disposed within the coil is described in further detail below.

Figure 5:
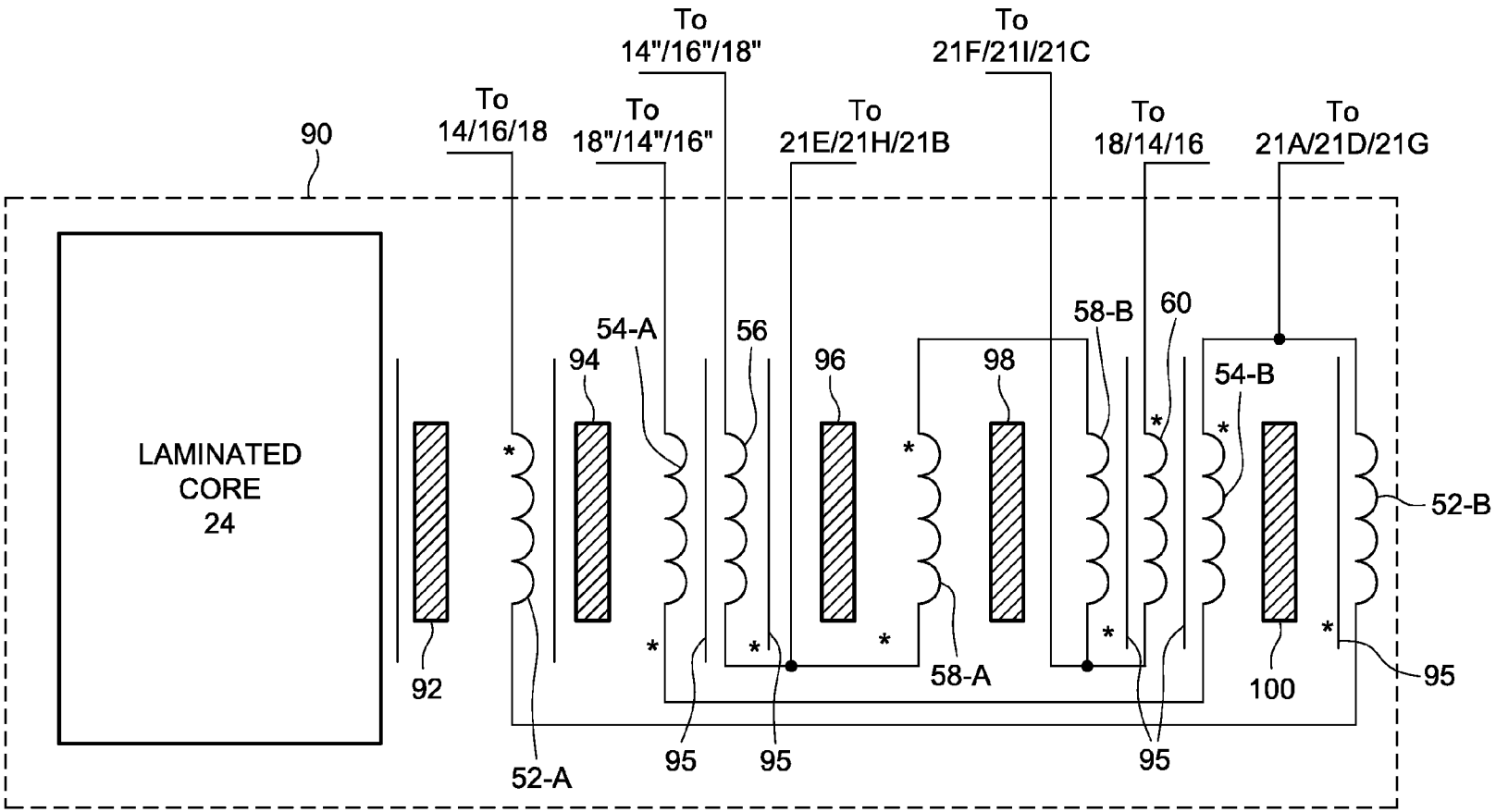

FIG. 5 is a cross sectional view of the transformer 20 employing cooling ducts according to aspects of the present technique. In the illustrated embodiment, the transformer 20 employs 5 cooling ducts on each side of the coil. The cooling ducts are disposed between the windings of each coil. The embodiments below are described with reference to coil 32. However similar designs may be employed for coils 34 and 36 as well. The manner in which the cooling ducts are disposed is described below.

It may be noted that winding 52 includes two portions that are generally represented by 52-A and 52-B. Similarly, winding 54 includes two portions and is generally represented by 54-A and 54-B and winding 58 includes two portions and is generally represented by 58-A and 58-B. Further, an insulating layer 95 is disposed between the windings as shown.

As illustrated, a cooling duct 92 is disposed between the laminated core 24 and portion 52-A of the winding 52. Further, a cooling duct 94 is disposed between the portions 52-A and 54-A of the windings 52 and 54 respectively. Similarly, a cooling duct 96 is disposed between the winding 56 and a first portion of the winding 58-A. Moreover, a cooling duct 98 is disposed between portions 58-A and 58-B of the winding 58 and a cooling duct 100 is disposed between portions 54-B and 52-B of the windings 54 and 52 respectively.

Here, the input terminals 14, 16 and 18 are positioned on the top side 90 of the transformer 20. Similarly, the output terminals 21-A through 21-I are also positioned on the top side 90 of transformer 20. As can be seen, all the input terminals 14, 16 and 18 and the output terminals 21-A through 21-I are disposed on an outer surface of the transformer.

Figure 6:
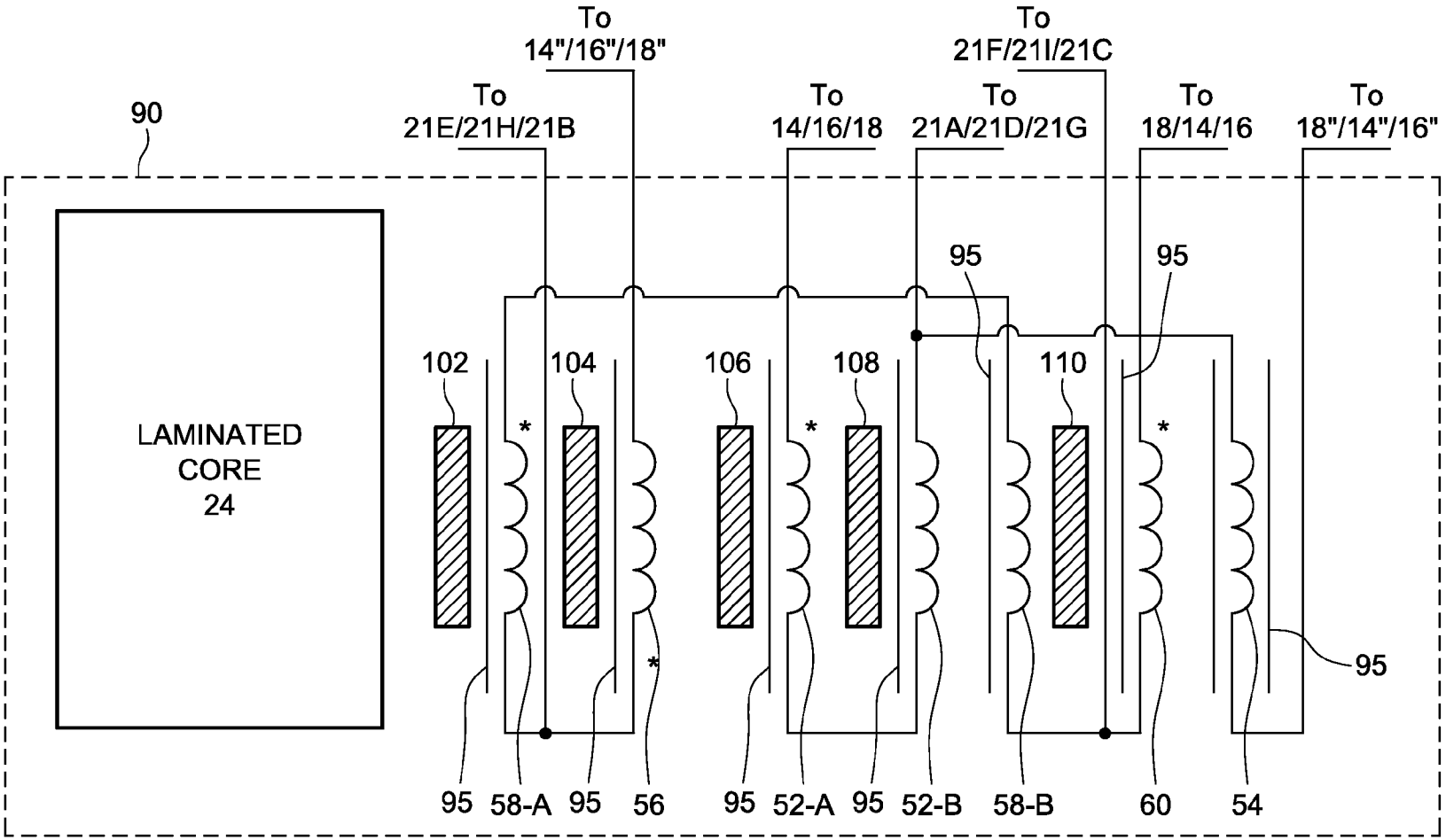

FIG. 6 is a cross sectional view of a second embodiment of the transformer 20 employing cooling ducts according to aspects of the present technique. In the illustrated embodiment, the transformer 20 employs 5 cooling ducts on each side of the coil. The cooling ducts are disposed between the windings.

In the illustrated embodiment, the winding 52 includes two portions and is generally represented by 52-A and 52-B and the winding 58 includes two portions and is generally represented by 58-A and 58-B. A cooling duct 102 is disposed between the laminated core 24 and portion 58-A of the winding 58. Further, a cooling duct 104 is disposed between winding 58-A and winding 56. A cooling duct 106 is disposed between winding 56 and winding 52-A. Moreover, a cooling duct 108 is disposed between portions 52-A and 52-B of the winding 52 and a cooling duct 110 is disposed between the winding 58-B and winding 60.

Again, as with the embodiment of FIG. 5, the input terminals 14, 16 and 18 are positioned on the top side 90 of transformer 20. Similarly, the output terminals 21-A through 21-I are also positioned on the top side 90 of transformer 20.

FIG. 7 is a cross sectional view of a third embodiment of the transformer 20 employing cooling ducts according to aspects of the present technique. In the illustrated embodiment, transformer 20 employs 6 cooling ducts on each side of the coil. The cooling ducts are disposed between the windings. In the illustrated embodiment, the winding 52 includes two portions and is generally represented by 52-A and 52-B and the winding 58 includes two portions and is generally represented by 58-A and 58-B. The manner in which the cooling ducts are disposed is described below.

A cooling duct 112 is disposed between the laminated core 24 and portion 58-A of the winding 58. Further, a cooling duct 114 is disposed between winding 58-A and the winding 56. A cooling duct 116 is disposed between the winding 56 and portion 52-A of the winding 52 and a cooling duct 118 is disposed between windings 52-A and 52-B. Moreover, a cooling duct 120 is disposed between winding 52-B and winding 60 and a cooling duct 122 is disposed winding 60 and winding 58-B.

The input terminals 14, 16 and 18 are positioned on the top side 90 of transformer 20. Similarly, the output terminals 21-A through 21-I are also positioned on the top side 90 of transformer 20.

FIG. 8 is a cross sectional view of a third embodiment of the transformer 20 employing cooling ducts according to aspects of the present technique. In the illustrated embodiment, transformer 20 employs 7 cooling ducts disposed on each side of the coil. The cooling ducts are disposed between the windings as shown. In the illustrated embodiment, winding 52 includes two portions and is generally represented by 52-A and 52-B and winding 58 includes two portions and is generally represented by 58-A and 58-B. The manner in which the cooling ducts are disposed is described below.

A cooling duct 126 is disposed between the laminated core 24 and winding 58-A and a cooling duct 128 is disposed between 58-A and winding 56. Further, a cooling duct 130 is disposed between winding 56 and winding 52-A and a cooling duct 132 is disposed between 52-A and winding 52-B. Moreover, a cooling duct 134 is disposed between 52-B and winding 58-B and a cooling duct 136 is disposed 58-B and winding 54. Cooling duct 138 is disposed winding 54 and winding 60.

The input terminals 14, 16 and 18 are positioned on the top side 90 of transformer 20. Similarly, the output terminals 21-A through 21-I are also positioned on the top side 90 of transformer 20

FIG. 9 is a flow chart illustrating an exemplary technique for making a transformer according to aspects of the present invention. The transformer is configured to generate a 9 phase output AC power from a 3 phase input AC power. The flow chart 140 describes one method by which the multi-phase transformer is constructed. At step 142, a first, second and third coils are constructed around a laminated core to form a transformer. Each coil includes a plurality of windings coupled together in series. In one embodiment, each coil includes 5 separate windings. In one embodiment, the windings are coupled together to form a hexagon.

At step 144, a plurality of cooling ducts is provided for each coil. Specifically, at least one cooling duct is disposed between the laminated core and the first winding of the coil. In one embodiment, the cooling duct is an air gap. In one embodiment, each coil has at least 5 cooling ducts. In one embodiment, each coil has 7 cooling ducts.

At step 146, 3 input terminals and 9 output terminals are provided on an outer surface of the transformer. In one embodiment, the input and output terminals are provided on a top side of the transformer. In addition, the input terminals and output terminals are positioned adjacent to cooling ducts.

The above described invention has several advantages including minimizing the leakage inductance difference in windings of each coil. Also, the transformer is cooled efficiently since the cooling ducts are positioned adjacent to the core of the transformer. In addition, the input and output terminals positioned on an outer surface of the transformer allows easy interface with other systems.

While only certain features of the invention have been illustrated and described herein, many modifications and changes will occur to those skilled in the art. It is, therefore, to be understood that the appended claims are intended to cover all such modifications and changes as fall within the true spirit of the invention.

Element List

10 Power System
12 Power Source
14 Input terminal
16 Input terminal
18 Input terminal
20 Transformer
21-A through 21-I Output terminals
22 Rectifier
24 Core
26 Pole
28 Pole
30 Pole
32 Coil
34 Coil
36 Coil
35 Cooling Duct
38 Hexagon
40 First leg
42 Second leg
44 Third leg
46 Fourth leg
48 Fifth leg
50 Sixth leg

52 First winding
54 Second winding
56 Third winding
58 Fourth winding
60 Fifth winding
62 First winding
64 Second winding
66 Third winding
68 Fourth winding
70 Fifth winding
72 First winding
74 Second winding
76 Third winding
78 Fourth winding
80 Fifth winding
81-89 Nodes
92,94,96,98,100 Cooling ducts
95 Insulating Layer
102,104,106,108 and 110 Cooling ducts
112,114,116,118,120 and 122 Cooling ducts
126,128,130,132,134,136 and 138 Cooling ducts

The invention claimed is:

1. A transformer system for converting 3 phase AC power to 9 phase AC power, the transformer comprising:
a laminated core comprising integral first, second and third poles;
first, second and third coils constructed on the first, second and third poles of the laminated core, respectively, wherein each coil includes:
a plurality of windings;
a plurality of cooling ducts, wherein at least one of the plurality of cooling ducts is disposed between one of the poles of the laminated core and an adjacent winding of the respective coil, and wherein a first portion of a first winding in the plurality of windings and a second portion of the first winding are positioned adjacent to at least one different cooling duct of the plurality of cooling ducts;
first, second and third input terminals linked to the first, second and third coils, and configured to receive first, second and third phases of input AC power; and
first through ninth output terminals communicatively linked to first through ninth output power lines.

2. The transformer system of claim 1, wherein the first, second and third input terminals and the first through ninth output terminals are disposed on an outer surface of the transformer.

3. The transformer system of claim 2, wherein the first, second and third input terminals and the first through ninth output terminals are disposed on a top side of the transformer.

4. The transformer system of claim 1, wherein the first, second and third input terminals and the first through ninth output terminals are disposed adjacent to the plurality of cooling ducts.

5. The transformer system of claim 1, wherein an inductance of at least two windings of the plurality of windings are unequal.

6. The transformer system of claim 1, wherein each cooling duct comprises an air gap.

7. The transformer system of claim 1, wherein the plurality of cooling ducts is configured to balance a leakage current in each coil.

8. The transformer of claim 1, wherein the plurality of cooling ducts comprise at least five cooling ducts.

9. A transformer for converting 3 phase AC power to 9 phase AC power, the transformer comprising:
a laminated core comprising integral first, second and third poles;
first, second and third coils constructed on the first, second and third poles of the laminated core, respectively, wherein each coil includes:
a plurality of windings;
a plurality of cooling ducts, wherein at least one of the plurality of cooling ducts is disposed between one of the poles of the laminated core and an adjacent winding of the respective coil, and wherein a first portion of a first winding in the plurality of windings and a second portion of the first winding are positioned adjacent to at least one different cooling duct of the plurality of cooling ducts;
first, second and third input terminals linked to the first, second and third coils, and configured to receive first, second and third phases of input AC power, and
first through ninth output terminals linkable to first through ninth output power lines.

10. The transformer of claim 9, wherein the first, second and third input terminals and the first through ninth output terminals are disposed on a top side of the transformer.

11. The transformer of claim 9, wherein the first, second and third input terminals and the first through ninth output terminals are disposed adjacent to the plurality of cooling ducts.

12. The transformer of claim 9, wherein the plurality of windings comprises the first, a second, a third, a fourth and a fifth winding,
wherein the plurality of cooling ducts comprises a first, a second, a third, a fourth and a fifth cooling duct,
wherein the first portion of the first winding is between the first cooling duct and the second cooling duct,
wherein a first portion of the second winding and the third winding are between the second cooling duct and the third cooling duct,
wherein a first portion of the fourth winding is between the third cooling duct and the fourth cooling duct,
wherein a second portion of the third winding, the fifth winding and a second portion of the second winding are between the fourth cooling duct and the fifth cooling duct, and
wherein the second portion of the first winding is disposed on an opposite side of the fifth cooling duct than the second winding.

13. The transformer of claim 9, wherein the plurality of windings comprises the first, a second, a third, a fourth and a fifth winding,
wherein the plurality of cooling ducts comprises a first, a second, a third, a fourth and a fifth cooling duct,
wherein a first portion of the fourth winding is between the first cooling duct and the second cooling duct,
wherein the third winding is between the second cooling duct and the third cooling duct,
wherein the first portion of the first winding is between the third cooling duct and the fourth cooling duct,
wherein the second portion of the first winding and a second portion of the fourth winding are between the fourth cooling duct and the fifth cooling duct, and
wherein the fifth winding is between the fifth cooling duct and the second winding.

14. The transformer of claim 9, wherein the plurality of windings comprises the first, a second, a third, a fourth and a fifth winding,
wherein the plurality of cooling ducts comprises a first, a second, a third, a fourth, a fifth and a sixth cooling duct, wherein a first portion of the fourth winding is between the first cooling duct and the second cooling duct, wherein the third winding is between the second cooling duct and the third cooling duct, wherein the first portion of the first winding is between the third cooling duct and the fourth cooling duct, wherein the second portion of the first winding is between the fourth cooling duct and the fifth cooling duct, wherein the fifth winding is between the fifth cooling duct and the sixth cooling duct, and wherein a second portion of the fourth winding is between the sixth cooling duct and the second winding.

15. The transformer of claim 9, wherein the plurality of windings comprises the first, a second, a third, a fourth and a fifth winding, wherein the plurality of cooling ducts comprises a first, a second, a third, a fourth, a fifth, a sixth and a seventh cooling duct, wherein a first portion of the fourth winding is between the first cooling duct and the second cooling duct, wherein the third winding is between the second cooling duct and the third cooling duct, wherein the first portion of the first winding is between the third cooling duct and the fourth cooling duct, wherein the second portion of the first winding is between the fourth cooling duct and the fifth cooling duct, wherein a second portion of the fourth winding is between the fifth cooling duct and the sixth cooling duct, wherein the second winding is between the sixth cooling duct and the seventh cooling duct, and wherein the fifth winding is disposed on an opposite side of the seventh cooling duct than the second winding.

16. A method for making a transformer for converting 3 phase AC to 9 phase AC power, the method comprising:

constructing first, second and third coils around integral first, second, and third poles of a laminated core, each coil having a plurality of windings coupled together to form a transformer, providing a plurality of cooling ducts for each coil such that at least one of the plurality of cooling ducts is disposed between one of the poles of the laminated core and an adjacent winding of the respective coil, and wherein a first portion of a first winding in the plurality of windings and a second portion of the first winding are positioned adjacent to at least one different cooling duct of the plurality of cooling ducts; and providing 3 input terminals and 9 output terminals on an outer surface of the transformer.

17. The method of claim 16, comprising providing 3 input terminals and 9 output terminals on a top side or a bottom side of the transformer.

18. The method of claim 17, wherein the 3 input terminals and the 9 output terminals are disposed adjacent to the plurality of cooling ducts.

19. The method of claim 16, wherein each cooling duct comprises an air gap.

20. The method of claim 16, wherein the plurality of cooling ducts comprise at least five cooling ducts.

* * * * *